US011530843B2

(12) United States Patent
Han et al.

(10) Patent No.: US 11,530,843 B2
(45) Date of Patent: Dec. 20, 2022

(54) HEATING CORE FOR HOT AIR GUN USE AND HOT AIR GUN

(71) Applicant: Zhejiang Prulde Electric Appliance Co., Ltd., Jinhua (CN)

(72) Inventors: Ting Han, Jinhua (CN); Weiming Yang, Jinhua (CN)

(73) Assignee: Zhejiang Prulde Electric Appliance Co., Ltd., Jinhua (CN)

( * ) Notice: Subject to any disclaimer, the term of this patent is extended or adjusted under 35 U.S.C. 154(b) by 450 days.

(21) Appl. No.: 16/041,654

(22) Filed: Jul. 20, 2018

(65) Prior Publication Data

US 2019/0309988 A1 Oct. 10, 2019

(30) Foreign Application Priority Data

Apr. 9, 2018 (CN) ..... 201810313098.4

(51) Int. Cl.
*F24H 3/04* (2022.01)
*H05B 3/46* (2006.01)
*B24C 5/02* (2006.01)

(52) U.S. Cl.
CPC ..... *F24H 3/0423* (2013.01); *B24C 5/02* (2013.01); *H05B 3/46* (2013.01); *H05B 2203/005* (2013.01); *H05B 2203/022* (2013.01)

(58) Field of Classification Search
CPC .... F24H 3/0423; F24H 9/0052; F24H 9/1863; F24H 2250/02; F24H 2240/01;
(Continued)

(56) References Cited

U.S. PATENT DOCUMENTS 2,042,264 A * 5/1936 Levenhagen ..... F24H 3/0423 392/492
3,492,462 A * 1/1970 Schumacher ..... A45D 20/10 392/385
(Continued)

FOREIGN PATENT DOCUMENTS

CN 2113584 8/1992
CN 200979286 11/2007
(Continued)

OTHER PUBLICATIONS

"Search Report of China Counterpart Application", dated Dec. 25, 2019, p. 1-p. 3.

*Primary Examiner* — Shawntina T Fuqua
(74) *Attorney, Agent, or Firm* — JCIP Global Inc.

(57) ABSTRACT

The present disclosure provides a heating core for hot air gun use and a hot air gun. The heating core comprises: a mount support; and a heating wire arranged on the mount support; wherein the heating wire includes a close wound segment on a surface of which an insulating layer is provided, an interval between adjacent heating wires in the close wound segment is D, $0 \leq D \leq 2$ mm. The hot gun comprises a housing in which a hot air device producing hot air is provided, the hot air device comprising a heating core; a hot air tube provided at a front end of the housing, inside the hot air tube being disposed the heating core, wherein: the heating core is the heating core for hot air gun use according to any technical solution above. By providing a close wound segment on the heating wire and arranging an insulating layer on the surface of the heating wire, the heating capacity of the heating wire in the local space is increased, the heating density of the local space is improved, and thus the air-out temperature, working effect, and working efficiency of the hot air gun may be dramatically improved.

13 Claims, 7 Drawing Sheets

(58) Field of Classification Search
CPC ..... B24C 5/02; H05B 3/46; H05B 2203/005; H05B 2203/022
See application file for complete search history.

(56) References Cited

U.S. PATENT DOCUMENTS

| | | | | | |
|---|---|---|---|---|---|
| 4,629,864 | A * | 12/1986 | Wilson | F24H 3/0423 34/99 |
| 4,668,855 | A * | 5/1987 | Wilson | A45D 20/12 219/544 |
| 7,717,104 | B2 * | 5/2010 | Looft | B67B 7/16 126/25 B |
| 2010/0129157 | A1 * | 5/2010 | Reddy | A01M 21/04 405/128.7 |

FOREIGN PATENT DOCUMENTS

| | | | |
|---|---|---|---|
| CN | 201522108 | | 7/2010 |
| CN | 103148589 | A | 6/2013 |
| CN | 203231552 | U | 10/2013 |
| CN | 107014072 | | 8/2017 |
| CN | 107655206 | | 2/2018 |
| CN | 207100839 | | 3/2018 |
| EP | 0381976 | | 6/1993 |
| JP | S5440755 | | 3/1979 |

* cited by examiner

HEATING CORE FOR HOT AIR GUN USE AND HOT AIR GUN

FIELD

The present disclosure relates to the technical field of electric power tools, and more particularly relates to a heating core for hot air gun use and a hot air gun.

BACKGROUND

A hot air gun is a heating tool for heating air to emit a stream of hot air. Hot air guns have a variety of uses. Specifically, hot air guns can be used to strip old paints on metal surfaces, remove self-adhesive stickers, heat to bend plastic tubes, dry out damp wood, heat to shrink shrink film and shrink wrap packaging, derust, heat to shrink metal-connected polyethylene and heat to soften weldments, etc., which may also be used to solder or desolder a component using a hot air stream blown out from a gun core having a resistance heating wire.

However, for existing hot air guns, heat generated by the heating wire is not concentrated enough during use, but dispersedly distributed inside a hot air tube, resulting in loss of some heat through a hot air tube during the heating process and unsatisfactory air-out temperature, such that a desired working effect cannot be achieved, and the working efficiency of the hot air gun is lowered; what's worse, it will cause an over high temperature at a surface of the hot air tube, leading to an over high temperature of the housing, posing a potential risk of scalding the user.

SUMMARY

An objective of the present disclosure is to provide a heating core for hot air gun use and a hot air gun, which have a high air-out temperature and a high working efficiency, To achieve the objective above, the present disclosure adopts the following technical solution: a heating core for hot air gun use, comprising: a mount support and a heating wire arranged on the mount support, wherein the heating wire includes a close wound segment on a surface of which an insulating layer is provided, an interval between adjacent heating wires in the close wound segment is D, $0 \leq D \leq 2$ mm.

Further, the close wound segment has a hollow spiral shape, and an interval between neighboring heating wires in the close wound segment is D, $0 \leq D \leq 1$ mm.

Further, the close wound segment is transversely arranged along a central axis direction of the mount support; or, the close wound segment is longitudinally arranged, with a central axis of the close wound segment being arranged non-coplanarly perpendicular to the central axis of the mount support.

Further, an axial length of the close wound segment is L, and a diameter of the heating wire is d, $2\ d \leq L \leq 30\ d$.

Further, an insulating heat concentrating element is arranged inside a hollow cavity of the close wound segment.

Further, the heat concentrating element is a ceramic tube or a ceramic column.

Further, the insulating layer is a rare earth coating applied to the surface of the heating wire; or, the insulating layer is a rare earth bushing cladding the surface of the heating wire.

Further, the close wound segment is arranged proximal to an air outlet of the hot air gun.

Further, the close wound segment is in a lump shape; or the close wound segment is in a coil shape.

Further, a longitudinal section of the mount support is in a cross shape, wherein four close wound segments are provided and distributed at four inner angles of the mount support; or, the longitudinal section of the mount support is in a Y shape, wherein three close wound segments are provided and distributed at three inner angles of the mount support; or, the longitudinal section of the mount support is in a "⋆" shape, wherein five close wound segments are provided and distributed at five inner angles of the mount support; or, the longitudinal section of the mount support is in a "∗" shape, wherein six close wound segments are provided and distributed at six inner angles of the mount support; or, the longitudinal section of the mount support is in a "⁎" shape, wherein eight close wound segments are provided and distributed at eight inner angles of the mount support.

In another aspect of the present disclosure, the present disclosure further provides a hot air gun, comprising: a housing in which a hot air device producing hot air is provided, the hot air device comprising a heating core; a hot air tube provided at a front end of the housing, inside the hot air tube being disposed the heating core, wherein the heating core is the heating core for hot air gun use in any technical solution above.

Further, an outer mica sleeve and a ceramic sleeve are provided in the hot air tube to isolate the heating core from the hot air tube, wherein the ceramic sleeve is arranged outside of the mount support in a sleeved manner, the outer ceramic sleeve is arranged outside of the ceramic sleeve in a sleeved manner, and the hot air tube is arranged on the outer mica sleeve in a sleeved manner.

Further, an inner mica sleeve is provided in the hot air tube, the inner mica sleeve being arranged at a front end of the mount support in a sleeved mode to clad the close wound segment.

Further, the hot air gun comprises a battery pack, the battery pack being electrically connected to the hot air device and supplying power to the hot air device to actuate the hot air device to work; or, the hot air gun comprises a power cord, one end of the power cord being connected to alternating current, the other end thereof being electrically connected to the hot air device to supply power to the hot air device to actuate the hot air device to work.

Further, a ceramic air-out mesh is provided inside the front end of the hot air tube, air-out mesh openings being provided on the ceramic air-out mesh, the air-out mesh openings being distributed in a honeycomb shape.

In the present disclosure, the "close wound segment" refers to a segment of wound heating wires, where an interval between adjacent heating wires is no greater than 2 mm. The specific winding manner is not limited, which may be a spiral winding manner, or a crisscrossed winding manner, or any other winding manner, as long as the heating wires may be locally densified to increase the local heating capacity and heating density of the heating wires.

After adopting the technical solutions above, the present disclosure has the following advantages:

1. In the present disclosure, by arranging a close wound segment for the heating wires and setting the interval between adjacent heating wires in the close wound segment to D, $0 \leq D \leq 2$ mm, the heating wires are locally densified to increase the heating capacity of the heating wires at a local space and increase the heating density of the local space, which greatly raises the air-out temperature, thereby guaranteeing the working effect of the hot air gun; besides, it is not needed to increase the amount of heating wires, which facilitates reduction of energy consumption and improves heating efficiency, and meanwhile enhances the working efficiency of the hot air gun. In other words, for heating wires with a same length, local heating capacity produced by the heating wire configured with the close wound segment is greater than that produced by the heating wires without configuring a close wound segment, because the heat capacity produced by the close wound segment is concentrated and not easily dispersed, which raises the temperature of the hot air blown out; while the heat capacity produced by the heating wire without configuring a close wound segment is not concentrated enough, which causes easy dispersion of the heat, thereby greatly decreasing the temperature of the hot air blown out. Further, because the heat is concentrated and not easily dispersed, the surface temperature of the hot air tube or housing will not be over high, which would otherwise scald the user, thereby enhancing the safety of using the hot air gun. Arranging an insulating layer may prevent short-circuit due to contact between heating wires in the close wound segment, which would otherwise burn down the heating wires, thereby guaranteeing normal working of the heating wire. When D is greater than 2 mm, the formed close wound segment will not be dense enough, which leads to insufficiency of the local heating capacity of the heating wire, thereby affecting the air-out temperature.

2. The close wound segment is in a hollow spiral shape, which facilitates winding and forming of the close wound segment with a high production efficiency; further, setting the close wound segment to be hollow facilitates the wind produced by the hot air device to carry away the heat in the close wound segment; without obstruction for the air, the heat will not be dispersed, such that the heat and the air will be blown to a same direction, which greatly increases the temperature of the hot air blown out; further, the interval between neighboring heating wires in the close wound segment is set to D, $0 \leq D \leq 1$ mm; when D=0, i.e., when the neighboring heating wires are closely attached to each other, they will be closely contacted; or a tiny interval is set, i.e., an interval smaller than or equal to 1 mm, then the produced heat will be more concentrated and not easily dispersed, which guarantees the sufficient temperature of the blown hot air, thereby guaranteeing the working effect of the hot air gun and improving the working efficiency of the hot air gun. When the interval is greater than 1 mm, the heat produced by the close wound segment is easily dispersed, which lowers the temperature of the blown hot air.

3. By setting the close wound segment transversely along the central axis direction of the mount support, the close wound segment is maintained consistent with the air-out direction of the hot air gun, such that when the air is blown out, it completely goes through the close wound segment, i.e., the air is completely through the close wound segment, which guarantees that the air may completely carry away the heat in the close wound segment to thereby guarantee that the air blown out has a sufficient temperature, thereby guaranteeing the working effect of the hot air gun and improving the working efficiency of the hot air gun; meanwhile, it reduces space occupation on the mount support by the close wound segment, causing the structure of the heating core more compact; further, a space for the hot air tube is reserved, which increases the air-out volume of the hot air tube, further improving the air discharging efficiency and working efficiency of the hot air gun.

4. Setting the axial length L of the close wound segment between 5 mm~30 mm guarantees enough length of the close wound segment, thereby guaranteeing sufficient heating capacity of the close wound segment, further guaranteeing sufficient temperature of the hot air blown out; meanwhile, a reasonable length will lead to a reasonable number of windings of the manufactured close wound segment, which guarantees production efficiency of the close wound segment; moreover, it also makes the axial length of the heating core reasonable, thereby further facilitating the design and layout of the subsequent structures of the hot air gun, causing the hot air gun compact and reasonably arranged as a whole. When L is less than 5 mm, the too short length will cause insufficient heat production, which lowers the temperature of the hot air blown out; when L is greater than 30 mm, the too long length is inconvenient for manufacturing and processing the close wound segment, which will also result in a too long axial length of the hot air gun.

5. By setting an insulating heat concentrating element inside the hollow cavity of the close wound segment, heat produced by the heating wire may be better concentrated and not easily dispersed; in this way, when the air is blown out, it not only absorbs the temperature of the heating wire, but also absorbs the temperature of the heat concentrating element, which better guarantees the temperature of the hot air blown out; meanwhile, insulativity of the concentrating element prevents the heat concentrating element from contacting with the heating wire, which would otherwise cause the heating wire to be short-circuited, thereby guaranteeing normal working of the heating wire.

6. The heat concentrating element is specifically a ceramic tube or a ceramic column, which not only guarantees a good heat concentration performance, but also guarantees a good insulativity; besides, it is durable and wear-resistant, thereby having a long service life.

7. The insulating layer is specifically a rare earth coating applied to the surface of the heating wire, which facilitates processing of the insulating layer, such that it not only guarantees the insulativity between heating wires in the close wound segment, but also facilitates forming of the close wound segment, thereby enhancing the production efficiency of the close wound segment.

8. By arranging the close wound segment proximal to an air outlet of the hot air gun, when the heating wire is producing heat, the wind produced by the hot air device of the hot gun may directly carry the heat away to form hot air, and the hot air formed in this way is directly blown out from the air outlet and directly blown to a to-be-heated object to perform a corresponding work, which shortens the blow-out path of the hot air and avoids loss of part of the heat due to the long path of blowing out the hot air, i.e., reducing the loss of the hot air inside the hot air tube, thereby guaranteeing the temperature of the hot air blown out, further guaranteeing the working effect of the hot air gun and improving the working efficiency of the hot air gun.

9. By setting the close wound segment to a lump or coil shape, the close wound segment may also produce a relatively large local heat; besides, the heat is concentrated and not easily dispersed, which may likewise achieve an effect of improving the air-out temperature of the hot air gun and enhancing the working effect of the hot air gun.

10. By setting the longitudinal section of the mount support to a cross shape or Y shape or "⋊" shape or "⋊" shape or ⋊ shape, a corresponding number of the close wound segments are correspondingly provided and distributed at respective inner angles, such that the respective close wound segments are spaced from each other; in this way, working of respective close wound segments will not be affected, and concentration of the heat between respective close wound segments is still guaranteed, such that the heat is not easily dispersed; as a result, the air-out temperature is guaranteed, thereby further guaranteeing the working effect of the hot air gun and improving the working efficiency of the hot air gun.

11. The present disclosure further provides a hot air gun, wherein a heating core in the hot air device of the hot air gun is the heating core for hot air gun use in any technical solution above, which thus may greatly increase the air-out temperature of the hot air gun, the working effect of the hot air gun, and the working efficiency of the hot air gun.

12. By arranging an outer mica sleeve and a ceramic sleeve inside the hot air tube, which space the heating core from the hot air tube, and by arranging the ceramic sleeve outside of the mount support in a sleeved manner, the ceramic sleeve concentrates the heat produced by the heating wire of the heating core such that the heat is not easily dispersed; while by arranging the outer mica sleeve outside of the ceramic sleeve in a sleeved manner and by arranging the hot air tube on the outer mica sleeve in a sleeved manner, the heat from the ceramic sleeve is further concentrated, preventing the heat on the ceramic sleeve from being dispersed and meanwhile further preventing heat from being transferred to the hot air tube, which may avoid the risk of scalding the user in case of accidentally touching the hot air tube.

13. By arranging an inner mica sleeve and arranging the inner mica sleeve to a front end of the mount support in a sleeved manner to clad the close wound segment, the heat generated by the close wound segment is exactly further concentrated by the inner mica sleeve such that it is not easily dispersed, which guarantees concentration and sufficiency of the heat produced by the close wound segment as well as the sufficiency of the air-out temperature, thereby further guaranteeing the working effect of the hot air gun and improving the working efficiency of the hot air gun.

14. By providing a battery pack, the hot air gun is simpler and more convenient to use; when working, the hot air gun will not be limited by the power cord, such that it may be manipulated in any direction; besides, without the limit of power cord length during working, the hot air gun may be conveniently carried to any working environment without worrying about the operation range issue, which may well avoid a dilemma that the work cannot be done in case of failing to find a receptacle when working outdoors; therefore, it may be well adapted to outdoor work, which greatly expands the application scope of the hot air gun and promotes the use convenience thereof; further, the battery pack has limited power capacity and the power produced is also limited; however, when the heating core in any technical solution above is adopted, because this heating core has little loss but a large heating capacity, the durability of the battery pack is well improved, i.e., the working duration of the hot air gun is prolonged, such that even a small power battery pack may achieve an effect of a very high air-out temperature, which guarantees sufficient air-out temperature so as to guarantee a good working effect of the hot air gun.

15. By arranging a ceramic air-out mesh inside the front end of the hot air tube and providing air-out mesh openings in the ceramic air-out mesh, the air-out mesh openings being distributed in a honeycomb shape; in this way the air blown out of the hot air gun has a uniform temperature, which will not cause a locally over high temperature, thereby guaranteeing the working effect and working stability of the hot air gun; further, the ceramic air-out mesh not only endures high temperature and resists against corrosion, but also may dissipate heat quickly when the hot air gun ends its work; therefore, it may well avoid scalding a human body, which enhances the safety of the hot air gun after use.

BRIEF DESCRIPTION OF THE DRAWINGS

Hereinafter, the present disclosure will be described in further detail with reference to the accompanying drawings.

Figure 1:
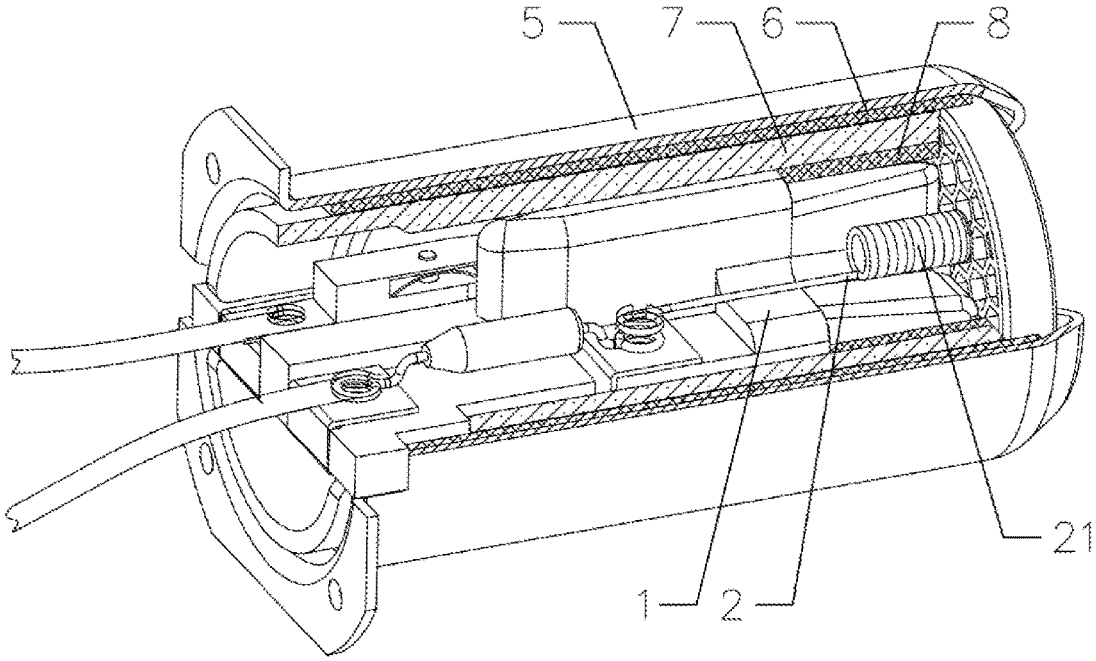
FIG. 1 is a mount diagram of Embodiment 1 of a heating core according to the present disclosure.
Figure 2:
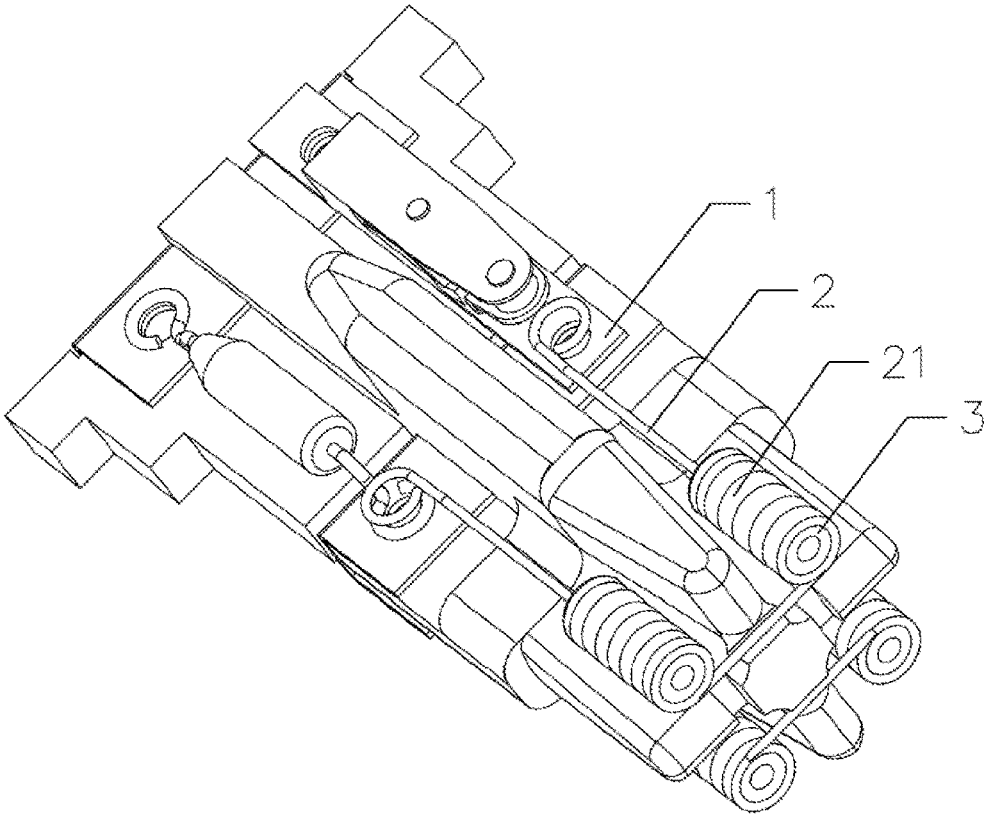
FIG. 2 is a structural schematic diagram of Embodiment 1 of the heating core according to the present disclosure.
Figure 3:
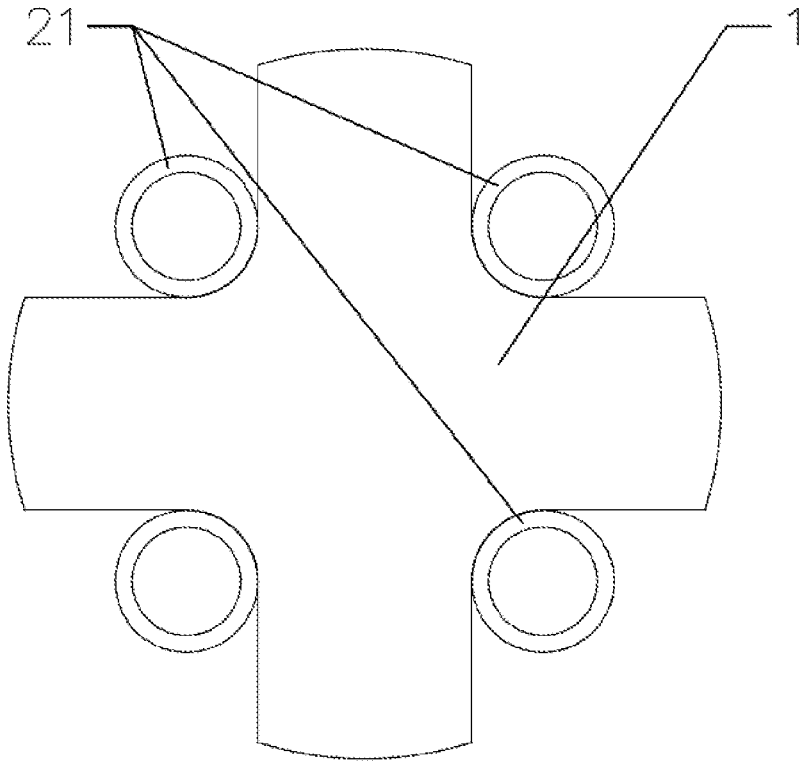
FIG. 3 is a right side view of Embodiment 1 of the heating core of the present disclosure.
Figure 4:
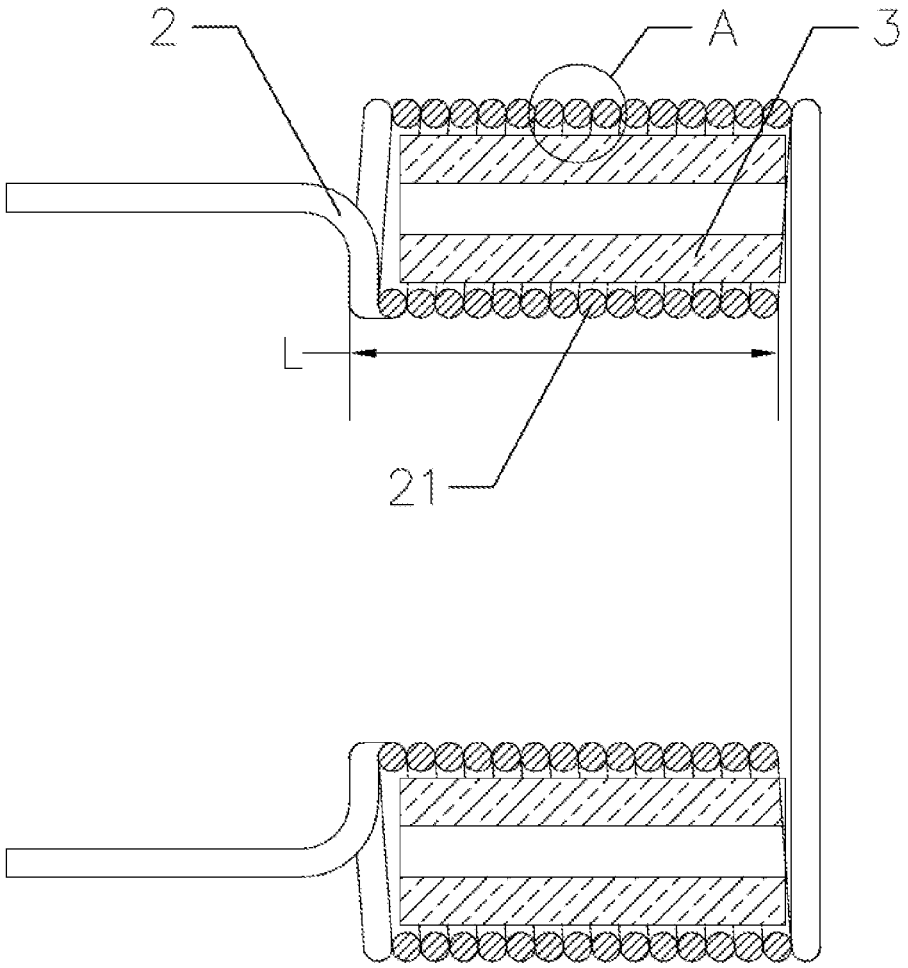
FIG. 4 is a sectional view of a close wound segment in Embodiment 1 of the heating core according to the present disclosure.
Figure 5:
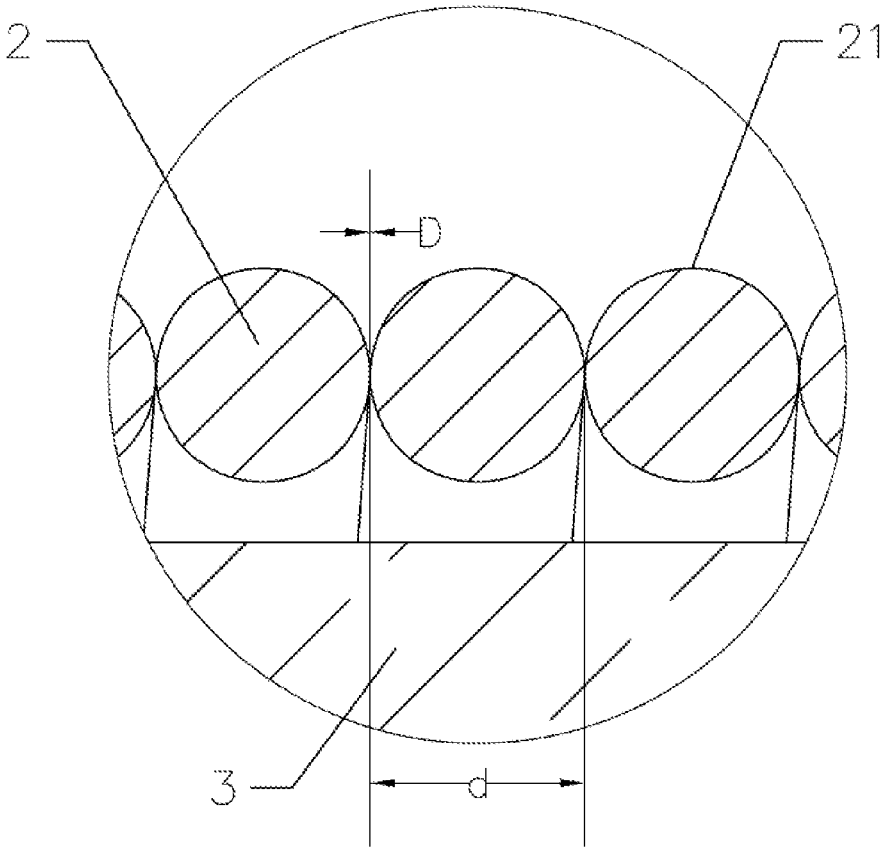
FIG. 5 is an enlarged view of A in FIG. 4.

Throughout the drawings, reference numerals of the respective parts are provided below:

1. Mount support; 2. Heating wire; 21. Close wound segment; 3. Heat concentrating element; 4. Housing; 5. Hot air tube; 6. Outer mica sleeve; 7. Ceramic Sleeve; 8. Inner mica sleeve; 9. Battery pack; 10. Ceramic air-out mesh; 101. Air-out mesh opening.

DETAILED DESCRIPTION OF EMBODIMENTS

Hereinafter, the present disclosure will be described in further detail with reference to the accompanying drawings and the embodiments.

Embodiment 1

As shown in FIGS. 1~5, the present disclosure provides a heating core for hot air gun use, comprising a mount support 1 and a heating wire arranged on the mount support 1, the mount support 1 being a ceramic mount support. The ceramic mount support may not only well concentrate the heat provided by the heating wire, but also may accumulate heat so as to well promote the heating effect of the entire heating core. The heating wire 2 comprises a close wound segment 21, where an interval between neighboring heating wires in the close wound segment 21 is D, $0 \leq D \leq 2$ mm. By arranging the close wound segment, the heating wires are locally densified to increase the heating capacity of the heating wires at a local space and increase the heating density of the local space, which greatly raises the air-out temperature, thereby guaranteeing the working effect of the hot air gun; besides, it is not needed to increase the amount of heating wires, which facilitates reduction of energy consumption and improves heating efficiency, and meanwhile enhances the working efficiency of the hot air gun. In other words, for heating wires with a same length, local heating capacity produced by the heating wire configured with the close wound segment is greater than that produced by the heating wires without configuring a close wound segment, because the heat capacity produced by the close wound segment is concentrated and not easily dispersed, which raises the temperature of the hot air blown out; while the heat capacity produced by the heating wire without configuring a close wound segment is not concentrated enough, which causes easy dispersion of the heat, thereby greatly decreasing the temperature of the hot air blown out. Further, because the heat is concentrated and not easily dispersed, the surface temperature of the hot air tube or housing will not be over high, which would otherwise scald the user, thereby enhancing the safety of using the hot air gun. An insulating layer is provided on a surface of the heating wire 2 in the close wound segment 21. Arrangement of the insulating layer may prevent short-circuit due to contact between heating wires in the close wound segment, which would otherwise burn down the heating wires, thereby guaranteeing normal working of the heating wire.

In this embodiment, the close wound segment 21 is in a hollow spiral shape, i.e., the close wound segment 21 is spirally wound by the heating wire 2, which facilitates winding and forming of the close wound segment with a high production efficiency; further, setting the close wound segment to be hollow facilitates the wind produced by the hot air device to carry away the heat in the close wound segment; without obstruction for the wind, the heat will not be dispersed, such that the heat and the air will be blown to a same direction, which greatly increases the temperature of the hot air blown out.

Specifically, the longitudinal section of the mount support 1 is in a cross shape, wherein four close wound segments 21 are provided and distributed at four inner angles of the mount support 1, wherein two close wound segments 21 are formed by a heating wire wound with a certain interval and mounted on the mount support side by side; the other two close wound segments 21 are formed by another heating wire 2 wound with a certain space and arranged relative to the preceding two close wound segments 21, thereby combining to form a heating core with four close wound segments, such that the respective close wound segments are spaced from each other, which will not affect working of respective close wound segments, but still guarantee concentration of the heat between respective close wound segments, such that the heat is not easily dispersed; in this way, it well guarantees sufficiency of the air-out temperature, thereby further guaranteeing the working effect of the hot air gun and improving the working efficiency of the hot air gun.

To better increase the air-out temperature, the interval between neighboring heating wires in the close wound segment 21 is set to D, $0 \leq D \leq 1$ mm; in this embodiment, D is specifically 0, i.e., the neighboring heating wires are closely attached to each other, such that they will be closely contacted; in this way, the produced heat will be more concentrated and not easily dispersed, which guarantees the sufficient temperature of the blown hot wind, thereby guaranteeing the working effect of the hot air gun and improving the working efficiency of the hot air gun.

To further increase the air-out temperature and make the structure of the heating core more compact, the close wound segment 21 is arranged transversely along the central axis direction of the mount support 1; in this way, the close wound segment is maintained consistent with the air-out direction of the hot air gun, such that when the air is blown out, it completely goes through the close wound segment, i.e., the air is completely through the close wound segment, which guarantees that the air may completely carry away the heat in the close wound segment to thereby guarantee that the air blown out has a sufficient temperature, thereby guaranteeing the working effect of the hot air gun and improving the working efficiency of the hot air gun; meanwhile, it reduces space occupation on the mount support by the close wound segment, causing the structure of the heating core more compact; further, a space for the hot air tube is reserved, which increases the air-out volume of the hot air tube, further improving the air discharging efficiency and working efficiency of the hot air gun.

To further increase the air-out temperature and the compactness of the structure, suppose that the axial length of the close wound segment 21 is L, the diameter of the heating wire 2 is d, L being set between 2 d and 30 d. In this embodiment, L is specifically 12 d. With a single heating wire as an example, L=12 d means that the close wound segment 21 is spirally wound by the heating wire 2 for 12 windings; further supposing that d is specifically 11 m, L then is 12 mm, which guarantees enough length of the close wound segment, thereby guaranteeing sufficient heating capacity of the close wound segment, further guaranteeing sufficient temperature of the hot air blown out; meanwhile, a reasonable length will lead to a reasonable number of windings of the manufactured close wound segment, which guarantees production efficiency of the close wound segment; moreover, it also makes the axial length of the heating core reasonable, thereby further facilitating the design and layout of the subsequent structures of the hot air gun, causing the hot air gun compact and reasonably arranged as a whole.

To further increase the air-out temperature and promote working stability, an insulating heat concentrating element 3 is provided inside a hollow cavity of the close wound segment 21, such that heat produced by the heating wire may be better concentrated and not easily dispersed; in this way, when the air is blown out, it not only absorbs the temperature of the heating wire, but also absorbs the temperature of the heat concentrating element, which better guarantees the temperature of the hot air blown out; meanwhile, insulativity of the concentrating element prevents the heat concentrating element from contacting with the heating wire, which would otherwise cause the heating wire to be short-circuited, thereby guaranteeing normal working of the heating wire. Specifically, the heat concentrating element 21 is a ceramic tube, which not only guarantees a good heat concentration, but also maintains a good insulativity; besides, it is endurable, wear-resistant, and has a long service life.

To guarantee the insulative effect of the insulating layer and the processing convenience, the insulating layer is specifically a rare earth coating applied to the surface of the heating wire 1, which facilitates processing of the insulating layer; in this way, it not only guarantees the insulativity between heating wires in the close wound segment, but also facilitates forming of the close wound segment, thereby enhancing the production efficiency of the close wound segment.

To better increase the air-out temperature, the close wound segment 21 is arranged proximal to an air outlet of the hot air gun, specifically at a front end of the mount support and proximal to the air outlet, such that when the heating wire is producing heat, the wind produced by the hot air device of the hot gun may directly carry the heat away to form hot air, and the hot air formed in this way is directly blown out from the air outlet and directly blown to a to-be-heated object to perform a corresponding work, which shortens the blow-out path of the hot air and avoids loss of part of the heat due to the long path of blowing out the hot air, i.e., reducing the loss of the hot air inside the hot air tube, thereby guaranteeing the temperature of the hot air blown out, further guaranteeing the working effect of the hot air gun and improving the working efficiency of the hot air gun.

It may be understood that the mount support may also be a mica mount support.

It may be understood that a tiny interval may also be set between neighboring heating wires in the close wound segment. Namely, D may also be 0.1 mm, 0.2 mm, 0.3 mm, 0.4 mm, 0.5 mm, 0.6 mm, 0.7 mm, 0.8 mm, 0.9 mm, 1 mm, 1.1 mm, 1.2 mm, 1.3 mm, 1.4 mm, 1.5 mm, 1.6 mm, 1.7 mm, 1.8 mm, 1.9 mm, 2 mm, etc. This setting may also cause the produced heat more concentrated and nor easily dispersed, which guarantees the sufficient temperature of the blown hot wind, thereby guaranteeing the working effect of the hot air gun and improving the working efficiency of the hot air gun.

It may be understood that the close wound segment may also be arranged longitudinally, i.e., the central axis of the close wound segment is arranged non-coplanarly perpendicular to the central axis of the mount support, which may also achieve an effect of raising the air-out temperature.

It may be understood that L can also be 2 d, 3 d, 4 d, 5 d, 6 d, 7 d, 8 d, 9 d, 10 d, 11 d, 13 d, 14 d, 15 d, 16 d, 17 d, 18 d, 19 d, 20 d, 21 d, 22 d, 23 d, 24 d, 25 d, 26 d, 27 d, 28 d, 29 d, 30 d, etc.

It may be understood that the heat concentrating element may also be a ceramic column, a through-hole for air to pass through being provided at a center of the ceramic column, which reduces the resistance for air out, increases the contact area between the air and the heat concentrating element, and well increases the air-out temperature.

It may be understood that the insulating layer may also be a rare earth bushing cladding the surface of the heating wire.

It may be understood that the close wound segment may also be in a lump shape, i.e., the close wound segment is formed by cross winding of the heating wire; of course, it may also be wound into other shapes, such as a spherical shape, a square shape, a bar shape, a column shape, a triangular shape, etc.; the close wound segment may also be in a coil shape. The coil shape means that it is formed by spirally winding of the heating wire; the wound coil is in a ring shape with an inner hole. Such formed coil is relatively orderly organized with a pleasant appearance. It may also be formed by cross winding of the heating wire, such that the heating wires are crisscrossed to form a ring-shaped coil. Such formed coil is relatively messy, but has a higher local density and a higher heat capacity.

It may be understood that, dependent on different structures and demands, the longitudinal section of the mount support may also be formed into a "⚹" shape or ⚹ shape. Correspondingly, the numbers of close wound segments are 5 and 8, respectively; in this way, working of respective close wound segments will not be affected, and concentration of the heat between respective close wound segments is still guaranteed, such that the heat is not easily dispersed; as a result, the air-out temperature is guaranteed, thereby further guaranteeing the working effect of the hot air gun and improving the working efficiency of the hot air gun.

It may be understood that, the heating wires may also be provided in two, three, four, or five, etc.; and a plurality of heating wires are arranged side by side, such that when winding the close wound segment, e.g., in the case of 4 heating wires, one winding will result in the axial length of winding one heating wire for four windings, thereby enhancing the production efficiency of the close wound segment. Such a close wound segment has a more concentrated heat, which is less easily dispersed. The specific number of heating wires may be determined based on the specific structure of the heating gun and the user needs.

It may be understood that the close wound segment may also be formed by a plurality of close wound segments with intervals. For example, it is formed by close wound segments with the axial lengths L being 2 d, 3 d, 4 d, 5 d, 6 d, 7 d, 8 d, 9 d, or 10 d, etc. Of course, the axial lengths of the plurality of close wound lengths arranged with intervals may also be different, e.g., the first close wound segment is 2 d, the second close wound segment is 3 d, the third close wound segment is 4 d, so on and so forth; or it may also be the case that the first close wound segment is 5 d, the second close wound segment is 3 d, and the third close wound segment is 2 d, etc. That is, the axial lengths may be decreasing or incremental, or may alternate between decrease and increment, or may even be arranged randomly, dependent on specific situations, which will not be detailed here.

Figure 6:
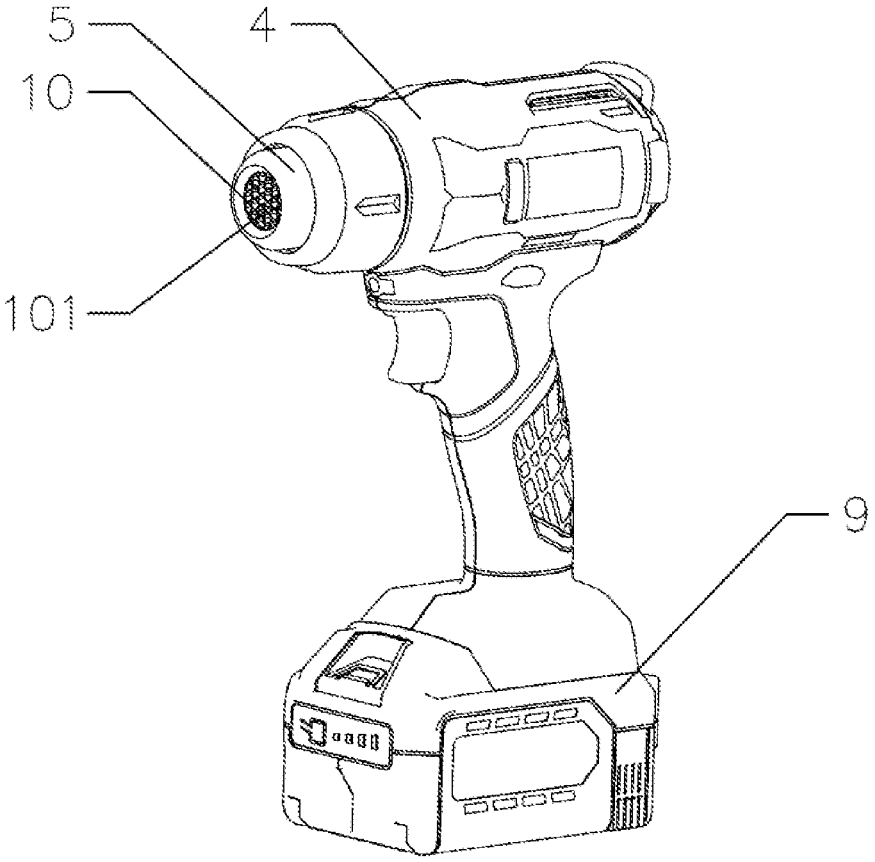
FIG. 6 is a structural schematic diagram of a hot air gun according to the present disclosure.

Finally, as shown in FIG. 6, the present disclosure further provides a hot air gun, comprising: a housing 4 in which a hot air device producing hot air is provided, the hot air device comprising a heating core; a hot air tube 5 provided at a front end of the housing, inside the hot air tube 5 being disposed the heating core, wherein the heating core is the heating core for hot air gun use in any technical solution above. In this way, the air-out temperature, the working effect and working efficiency of the hot air gun may be dramatically promoted.

Specifically, the hot air gun comprises a battery pack 9 that is electrically connected with the hot air device to supply power to the hot air device to actuate the hot air device to work. By arranging the battery pack, the hot air gun is simpler and more convenient to use; when working, the hot air gun will not be limited by the power cord, such that it may be manipulated in any direction; besides, without the limit of power cord length during working, the hot air gun may be conveniently carried to any working environment without worrying about the operation range issue, which may well avoid a dilemma that the work cannot be done in case of failing to find a receptacle when working outdoors; therefore, it may be well adapted to outdoor work, which greatly expands the application scope of the hot air gun and promotes the use convenience thereof; further, the battery pack has limited power capacity and the power produced is also limited; however, when the heating core in any technical solution above is adopted, because this heating core has little loss but a large heating capacity, the durability of the battery pack is well improved, i.e., the working duration of the hot air gun is prolonged, such that even a small power battery pack may achieve an effect of a very high air-out temperature, which guarantees sufficient air-out temperature so as to guarantee a good working effect of the hot air gun.

To further enhance the heat aggregating effect of the hot air tube, as shown in FIG. 1, an outer mica sleeve 6 and a ceramic sleeve 7 are provided in the hot air tube 5 to isolate the heating core from the hot air tube, wherein the ceramic sleeve 7 is arranged outside of the mount support 1 in a sleeved manner, the outer ceramic sleeve 6 is arranged outside of the ceramic sleeve 6 in a sleeved manner, and the hot air tube 5 is arranged on the outer mica sleeve 6 in a sleeved manner. In this way, the heat generated by the close wound segment is exactly further concentrated by the inner mica sleeve such that it is not easily dispersed, while by arranging the outer ceramic sleeve outside of the ceramic sleeve in a sleeved manner and arranging the hot air tube on the outer mica sleeve in a sleeved manner, the heat from the ceramic sleeve is further concentrated, preventing the heat on the ceramic sleeve from being dispersed and meanwhile further preventing heat from being transferred to the hot air tube, which may avoid the risk of scalding the user in case of accidentally touching the hot air tube.

To further enhance the heat aggregating effect of the hot air tube, as shown in FIG. 1, an inner mica sleeve 8 is provided in the hot air tube 5, wherein the inner mica sleeve 8 is arranged at a front end of the mount support 1 in a sleeved mode to clad the close wound segment 21, such that the heat generated by the close wound segment is exactly further concentrated by the inner mica sleeve such that it is not easily dispersed, which guarantees concentration and sufficiency of the heat produced by the close wound segment as well as the sufficiency of the air-out temperature, thereby further guaranteeing the working effect of the hot air gun and improving the working efficiency of the hot air gun.

To guarantee the working effect and working stability of the hot air gun, as shown in FIG. 6, a ceramic air-out mesh 10 is provided inside the front end of the hot air tube 5, air-out mesh openings 101 being provided on the ceramic air-out mesh 10, the air-out mesh openings 101 being distributed in a honeycomb shape; in this way, the air blown out of the hot air gun has a uniform temperature, which will not cause a locally over high temperature, thereby guaranteeing the working effect and working stability of the hot air gun; further, the ceramic air-out mesh not only endures high temperature and resists against corrosion, but also may dissipate heat quickly when the hot air gun ends its work; therefore, it may well avoid scalding a human body, which enhances the safety of the hot air gun after use.

It may be understood that the hot air gun may also be connected to alternating current through a power cord, the power cord being electrically connected to the hot air device to supply power to the hot air device so as to actuate the how wind device to word. The alternating current supplies power stably, which may guarantee that the hot air gun heats stably with sufficient wind power during use, such that work interruption will not easily occur due to instable voltage or current. In this way, the hot air gun may work continuously and stably indoors, and it will not occur that the work suspends due to insufficient battery level, thereby guaranteeing the working duration and working effect of the hot air gun.

Embodiment II

This embodiment differs from Embodiment I in the structure of the mount support.

Figure 7:
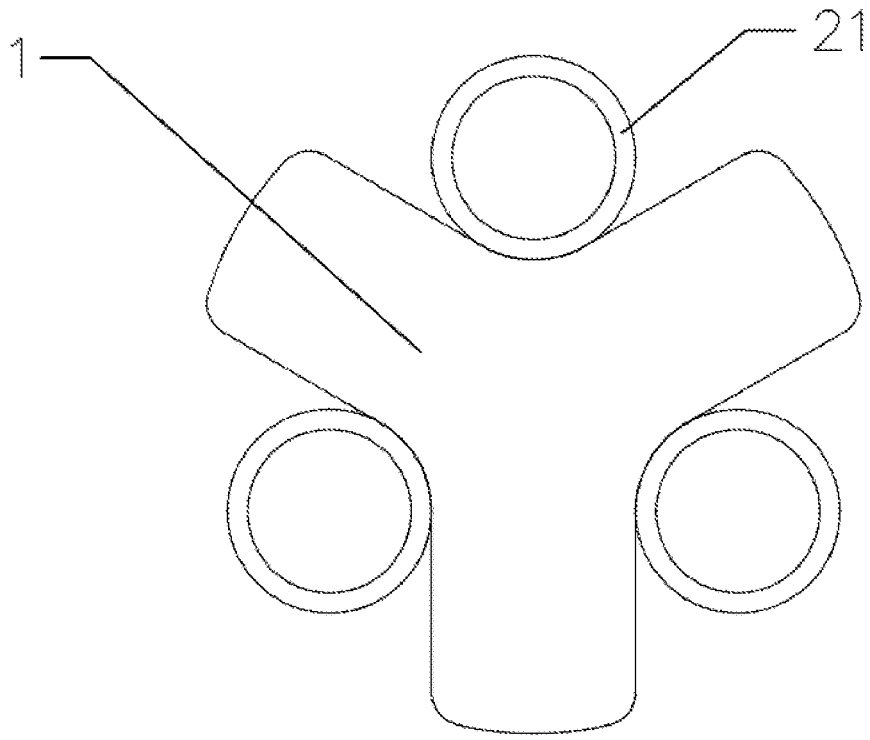
FIG. 7 is a right side view of Embodiment II of the heating core of the present disclosure.

In this embodiment, as shown in FIG. 7, the longitudinal section of the mount support is formed into a Y shape. Correspondingly, three close wound segments 21 are provided and distributed at three inner angles of the mount support 1, such that the respective close wound segments can be likewise spaced from each other, which will not affect working of respective close wound segments, but still guarantee concentration of the heat between respective close wound segments, such that the heat is not easily dispersed; in this way, it well guarantees sufficient air-out temperature, thereby further guaranteeing the working effect of the hot air gun and improving the working efficiency of the hot air gun.

The remaining structures not described here and their beneficial effects are all identical to Embodiment 1, which will not be detailed here.

Embodiment III

This embodiment differs from Embodiment I in the structure of the mount support.

Figure 8:
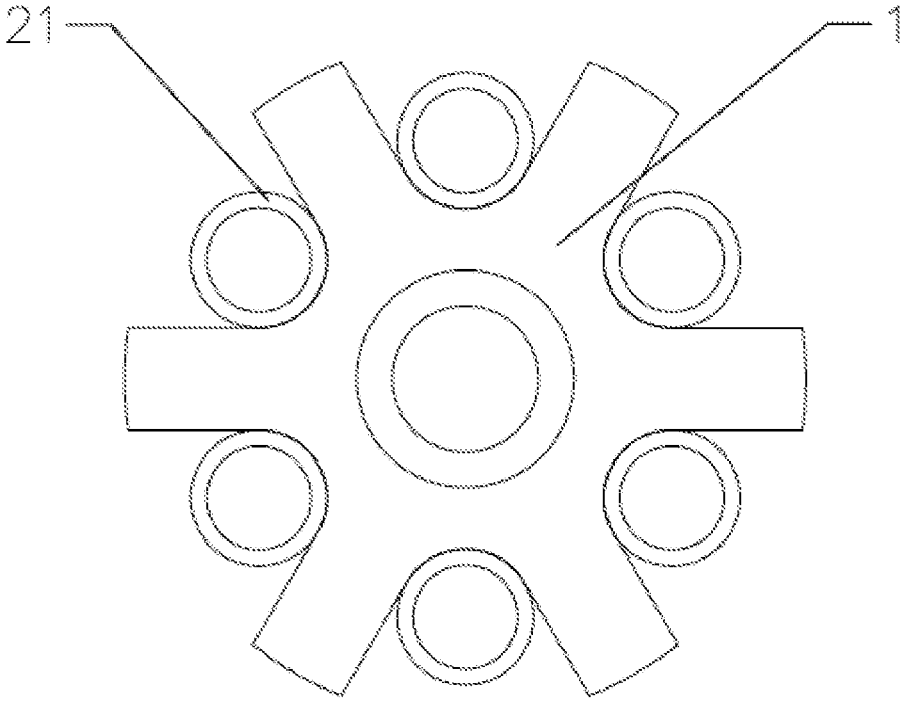
FIG. 8 is a right side view of Embodiment III of the heating core of the present disclosure.

In this embodiment, as shown in FIG. 8, the longitudinal section of the mount support is formed into a "⋆" shape. Correspondingly, six close wound segments 21 are provided and distributed at six inner angles of the mount support 1, such that the respective close wound segments can be likewise spaced from each other, which will not affect working of respective close wound segments, but still guarantee concentration of the heat between respective close wound segments, such that the heat is not easily dispersed; in this way, it well guarantees sufficient air-out temperature, thereby further guaranteeing the working effect of the hot air gun and improving the working efficiency of the hot air gun.

The remaining structures not described here and their beneficial effects are all identical to Embodiment 1, which will not be detailed here.

Besides the preferred embodiments above, the present disclosure further has other embodiments. Those skilled in the art may make various alterations and transformations based on the present disclosure, which should all fall into the scope defined by the appended claims of the present disclosure without departing from the spirit of the present disclosure.

We claim:

1. A heating core for hot air gun use, comprising:
a mount support; and
a heating wire arranged on the mount support; wherein
the heating wire includes a close wound segment on a surface of which an insulating layer is provided, the close wound segment has a hollow spiral shape, an interval between adjacent heating wires in the close wound segment is D, $0 \le D \le 1$ mm, an axial length of the close wound segment is L, and a diameter of the heating wire is d, $2\ d \le L \le 30\ d$.

2. The heating core for heating gun use according to claim 1, wherein the close wound segment is transversely arranged along a central axis direction of the mount support; or, the close wound segment is longitudinally arranged, with a central axis of the close wound segment being arranged non-coplanarly perpendicular to the central axis of the mount support.

3. The heating core for heating gun use according to claim 1, wherein an insulating heat concentrating element is arranged inside a hollow cavity of the close wound segment.

4. The heating core for heating gun use according to claim 3, wherein the heat concentrating element is a ceramic tube or a ceramic column.

5. The heating core for heating gun use according to claim 1, wherein the insulating layer is a rare earth coating applied to the surface of the heating wire; or, the insulating layer is a rare earth bushing cladding the surface of the heating wire.

6. The heating core for heating gun use according to claim 1, wherein the close wound segment is arranged proximal to an air outlet of the hot air gun.

7. The heating core for heating gun use according to claim 1, wherein the close wound segment is in a lump shape; or the close wound segment is in a coil shape.

8. The heating core for heating gun use according to claim 1, wherein:
a longitudinal section of the mount support is in a cross shape, wherein four close wound segments are provided and distributed at four inner angles of the mount support; or,
the longitudinal section of the mount support is in a Y shape, wherein three close wound segments are provided and distributed at three inner angles of the mount support; or,
the longitudinal section of the mount support is in a "⋆" shape, wherein five close wound segments are provided and distributed at five inner angles of the mount support; or, the longitudinal section of the mount support is in a "⚹" shape, wherein six close wound segments are provided and distributed at six inner angles of the mount support; or, the longitudinal section of the mount support is in a "⯐" shape, wherein eight close wound segments are provided and distributed at eight inner angles of the mount support.

9. A hot air gun, comprising:

a housing in which a hot air device producing hot air is provided, the hot air device comprising a heating core, the heating core comprising:

a mount support; and a heating wire arranged on the mount support, wherein the heating wire includes a close wound segment on a surface of which an insulating layer is provided, an interval between adjacent heating wires in the close wound segment is D, $0 \leq D \leq 2$ mm; and a hot air tube provided at a front end of the housing, inside the hot air tube being disposed the heating core, wherein:

an outer mica sleeve and a ceramic sleeve are provided in the hot air tube to isolate the heating core from the hot air tube, the ceramic sleeve is arranged outside of the mount support in a sleeved manner, the outer mica sleeve is arranged outside of the ceramic sleeve in a sleeved manner, and the hot air tube is arranged on the outer mica sleeve in a sleeved manner.

10. The hot gun according to claim 9, wherein an inner mica sleeve is provided in the hot air tube, the inner mica sleeve being arranged at a front end of the mount support in a sleeved mode to clad the close wound segment.

11. The hot gun according to claim 9, wherein:

the hot air gun comprises a battery pack, the battery pack being electrically connected to the hot air device and supplying power to the hot air device to actuate the hot air device to work; or, the hot air gun comprises a power cord, one end of the power cord being connected to alternating current, the other end thereof being electrically connected to the hot air device to supply power to the hot air device to actuate the hot air device to work.

12. The hot gun according to claim 9, wherein a ceramic air-out mesh is provided inside the front end of the hot air tube, air-out mesh openings being provided on the ceramic air-out mesh, the air-out mesh openings being distributed in a honeycomb shape.

13. A heating core for hot air gun use, comprising:

a mount support; and a heating wire arranged on the mount support; wherein the heating wire includes a close wound segment on a surface of which an insulating layer is provided, an interval between adjacent heating wires in the close wound segment is D, $0 \leq D \leq 2$ mm, wherein the insulating layer is a rare earth coating applied to the surface of the heating wire; or, the insulating layer is a rare earth bushing cladding the surface of the heating wire.

* * * * *